US010214325B2

(12) United States Patent
Rognard et al.

(10) Patent No.: US 10,214,325 B2
(45) Date of Patent: Feb. 26, 2019

(54) IN OR RELATING TO TAMPER-EVIDENT CLOSURES

(71) Applicant: Obrist Closures Switzerland GmbH, Reinach (CH)

(72) Inventors: Jean-Yves Rognard, Marcy-sur-Anse (FR); Daniel Holmes, Watford (GB); Darren Karl Garrett, Lidlington (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 15/306,335

(22) PCT Filed: Apr. 21, 2015

(86) PCT No.: PCT/EP2015/058593
§ 371 (c)(1),
(2) Date: Oct. 24, 2016

(87) PCT Pub. No.: WO2015/162128
PCT Pub. Date: Oct. 29, 2015

(65) Prior Publication Data

US 2017/0050773 A1 Feb. 23, 2017

(30) Foreign Application Priority Data

Apr. 24, 2014 (GB) ..... 1407269.8
Dec. 12, 2014 (GB) ..... 1422095.8

(51) Int. Cl.
*B65D 41/34* (2006.01)
*B65D 47/08* (2006.01)

(52) U.S. Cl.
CPC ..... *B65D 41/3428* (2013.01); *B65D 47/0804* (2013.01); *B65D 47/0852* (2013.01)

(58) Field of Classification Search
CPC ..... B65D 41/32; B65D 41/0435; B65D 41/0457; B65D 41/0464; B65D 41/3414;
(Continued)

(56) References Cited

U.S. PATENT DOCUMENTS 4,669,623 A * 6/1987 Csaszar ..... B65D 41/3452 215/252
4,801,030 A * 1/1989 Barriac ..... B65D 41/3428 215/252
(Continued)

FOREIGN PATENT DOCUMENTS

CN 1675108 9/2005
CN 101391673 A 3/2009
(Continued)

OTHER PUBLICATIONS

Chinese Application Serial No. 201580021163.0, First Office Action dated Jul. 24, 2017, 2 pgs.
(Continued)

*Primary Examiner* — Paul R Durand
*Assistant Examiner* — Andrew P Bainbridge
(74) *Attorney, Agent, or Firm* — Schwgman Lundberg & Woessner, P.A.

(57) ABSTRACT

A tamper-evident closure (10) for a container is provided. The closure (10) comprises a base (20) attachable to a container neck (50). The base (20) comprises a sidewall (21) having a tamper-evident drop band (40). The band includes an abutment (43) for engaging the container neck to cause the band to break away from the sidewall if an attempt is made to remove the closure from the neck once fitted. The band (40) further comprises an extension (45) against which the sidewall pushes if the closure is reapplied to push the band (40) away from the base (20).

17 Claims, 14 Drawing Sheets

(58) Field of Classification Search

CPC ..... B65D 41/3423; B65D 41/3433; B65D 41/3447; B65D 41/3428; B65D 47/0804; B65D 47/0852; B65D 47/0819; B65D 47/0847

USPC ..... 220/257.1, 268; 215/252, 251, 250, 253, 215/258, 329, 330, 34, 354; 222/153.01, 222/153.05, 153.09, 541.1–541.9

See application file for complete search history.

(56) References Cited

U.S. PATENT DOCUMENTS 4,907,708 A * 3/1990 Csaszar ..... B65D 41/3452 215/252
5,007,545 A * 4/1991 Imbery, Jr. ..... B29C 33/485 215/14
5,450,973 A * 9/1995 Ellis ..... B65D 41/0421 215/252
5,725,115 A * 3/1998 Bosl ..... B65D 41/3428 215/252
5,749,484 A * 5/1998 Trout ..... B29C 37/0014 215/219
5,819,965 A * 10/1998 King ..... B65D 41/3409 215/252
6,739,466 B1 * 5/2004 Culley ..... B65D 41/3428 215/216
6,908,013 B2 * 6/2005 Thomson ..... B65D 41/62 215/251
7,059,485 B1 * 6/2006 Reidenbach ..... B65D 41/3428 215/252
7,222,741 B2 * 5/2007 Chmela ..... B65D 51/18 215/252
7,611,025 B2 * 11/2009 Nusbaum ..... B65D 47/0838 215/235
8,763,830 B2 * 7/2014 Sadiq ..... B65D 41/325 215/252
2003/0127418 A1 * 7/2003 Schweigert ..... B65D 41/3447 215/252
2008/0173611 A1 * 7/2008 Neputy ..... B65D 41/3423 215/256
2010/0018942 A1 * 1/2010 Battegazzore ..... B65D 41/348 215/252
2010/0032402 A1 * 2/2010 Widmer ..... B65D 41/3409 215/252
2013/0200034 A1 * 8/2013 Kaanta ..... B65D 17/161 215/253
2017/0240326 A1 * 8/2017 Rognard ..... B65D 47/0809
2018/0170628 A1 * 6/2018 Rognard ..... B65D 47/0804

FOREIGN PATENT DOCUMENTS

CN 103153804 6/2013
CN 203237568 U 10/2013
DE 102012208628 B3 7/2013

OTHER PUBLICATIONS

International Patent Application No. PCT/EP2015/058593, Search Report and Written Opinion dated Aug. 28, 2015, 12 pgs.
"Chinese Application No. 201580021163.0, Second Office Action dated Apr. 20, 2018", dated Apr. 20, 2018, 3 pgs.

* cited by examiner

DETAIL L

DROP-BAND

RE-CLOSE

BACKED-OFF

DEFAULT

IN OR RELATING TO TAMPER-EVIDENT CLOSURES

This application is a U.S. National Stage Filing under 35 U.S.C. 371 from International Application No. PCT/EP2015/058593, filed on Apr. 21, 2015, and published as WO 2015/162128 A1 on Oct. 29, 2015, which claims the benefit of priority to United Kingdom Patent Application No. 1407269.8, filed on Apr. 24, 2014, and which claims the benefit of priority to United Kingdom Patent Application No. 1422095.8, filed on Dec. 12, 2014, each of which is hereby incorporated by reference herein in its entirety.

The present invention relates generally to closures and particularly to tamper-evident closures having a mechanism for informing a user if a closure has been opened/accessed at least once.

The present invention relates to a tamper-evident system for ensuring that a tamper-evidencing event is shown clearly; that there is a strong visual difference between the initial, unopened condition and the condition after tamper-evidencing has been activated.

According to an aspect of the present invention there is provided a tamper-evident closure for a container, the closure comprising a base attachable to a container neck, the base comprising a sidewall having a tamper-evident drop band, the band including an abutment for engaging the container neck to cause the band to break away from the sidewall if an attempt is made to remove the closure from the neck once fitted, the band further comprising an extension against which the sidewall pushes if the closure is reapplied to push/keep the band away from the base.

The sidewall may comprise an internal bead for pushing the extension in the reapplied position.

Part of the extension may be initially located above the bead and is pulled down over the bead upon removal of the closure, and thereafter cannot pass back over the bead.

The internal bead may be continuous or discontinuous.

The extension may comprise a plurality of flaps.

The band may be pushed so that it pressed towards or against a container neck transfer bead.

The band may be frangibly connected to a free end of the sidewall.

The drop band may comprise a folded band including the abutment and the extension.

The band may be formed with the flap in an unfolded position.

The base may be the closure. However, the closure may further comprise other parts, such as a lid.

The lid may be hingedly connected to the base.

There may be provided a tamper-evident means for indicating if the lid has been opened.

The base may comprise a dispensing member such a spout.

The member may comprise a self-closing valve.

The base may be screw threadable onto a neck. Other forms of connection may be used, such as a snap bead or the like.

The band may comprise anti-rotation means for improving breakage.

A further aspect provides a flip-top sportscap for a container neck, the sportscap comprising a screw-threaded base and a lid joined by a hinge, the base comprising a sidewall at the free end of which a tamper-evident drop-band is frangibly connected, the drop band comprising a folded flap having a part which engages a container neck in use and causes the band to break away from the sidewall if the base is unscrewed, the flap further comprising an extended free end and the sidewall comprising an abutment bead, the bead abutting against the free end of the band to push the band away from the free end of the sidewall if the base is re-screwed onto the neck.

The present invention also provides a container fitted with a closure as described herein.

The closure may comprise a tamper-evident drop band frangibly attached to the free end of a closure side skirt forming part of a main body. The drop band may be formed so that if the closure is removed and then replaced the main body pushes down onto part of the band.

In some embodiments the part of the band which is pushed away by the body is a folded flap.

This ensures that there is a clear gap between the free end of the side skirt and the band. The free end of the flap has a generally triangular geometry.

In some embodiments the body can push the band down until it contacts a container neck transfer bead or the like.

In some embodiments the body is provided with a bead or the like which pushes the band.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, by way of example, with reference to the accompanying drawings, in which.

Figure 1:
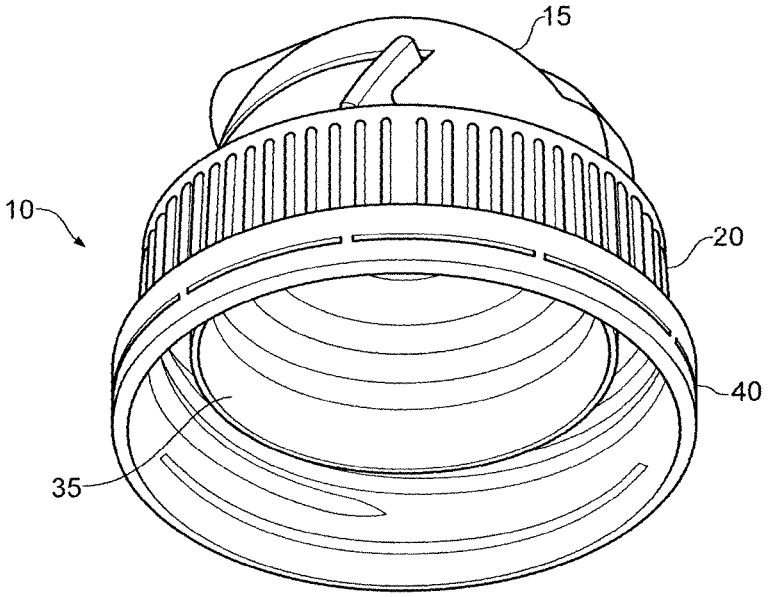
FIG. 1 is an underplan perspective view of a closure formed according to an embodiment of the present invention.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Figure 2A:
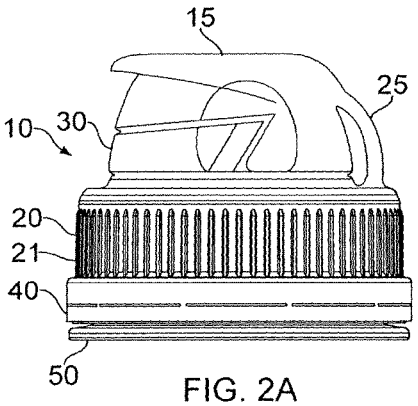
FIG. 2A is a side view of the closure of FIG. 1 shown fitted to a container neck.
Figure 2B:
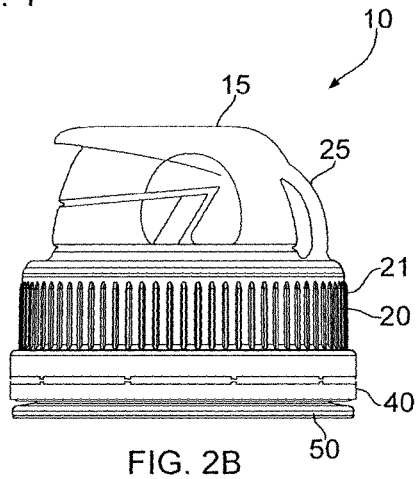
FIG. 2B is a side view of the closure of FIG. 2A following removal and re-closure of the closure from a container neck.
Figure 3:
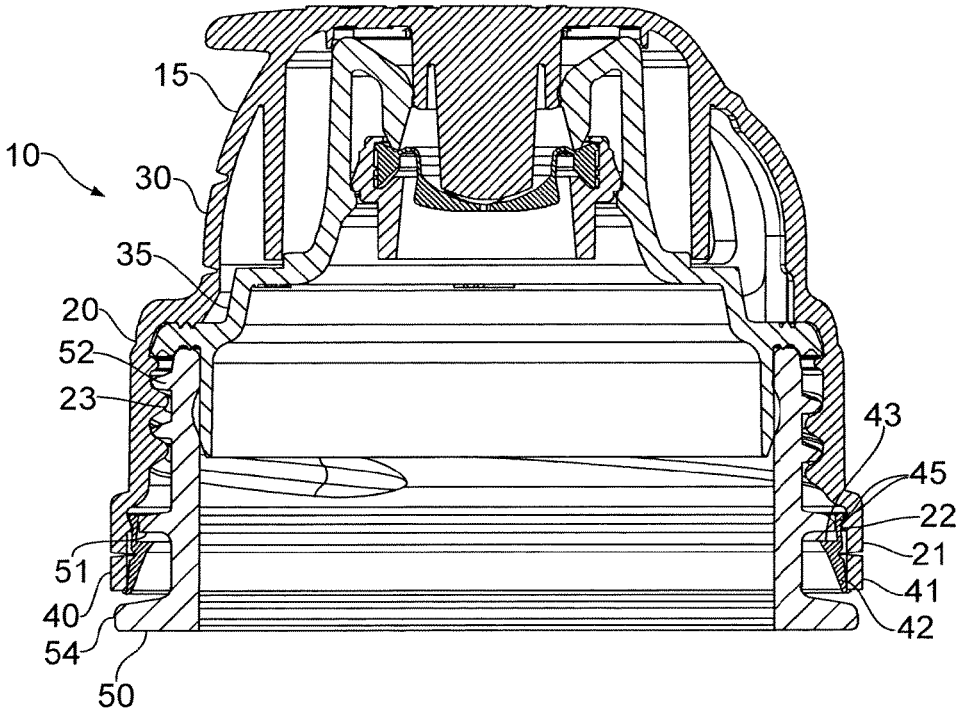
FIG. 3 is a section of the closure of FIG. 2A.

Referring first to FIGS. 1 to 3 there is shown a flip-top (sportscap) tamper-evident closure 10. The closure 10 includes a lid 15 connected to a base 20 by a hinge 25.

A tamper-evident strip 30 is provided to connect the lid 15 and the base 20 and must be torn off to allow the lid to be opened to reveal a drinking spout 35.

The base 20 includes a sidewall 21 and at the free end of the sidewall is a tamper-evident drop band 40.

Figure 4A:
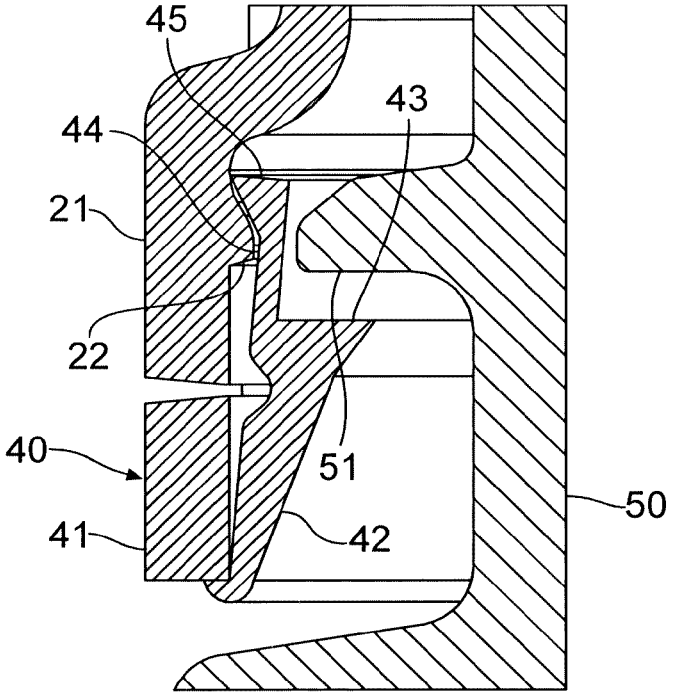
FIG. 4A is a magnified view of the region of a tamper-evident drop band forming part of the closure of FIG. 2A.

Referring also to FIG. 4A, the drop band 40 includes an annular band 41 frangibly connected to the free end of the sidewall, and a folded flap 42 that extends radially inwardly of the band.

The flap 42 includes an abutment surface 43 which engages under a tamper bead 51 of a container neck finish 50 and ensures that if the sidewall lifts (if an attempt is made to unscrew the closure) the drop band 40 is broken away from the sidewall 21 because the abutment surface 43 cannot pass over the bead 51.

Beyond the flap abutment surface 43 the flap 42 has an extension part 44 that terminates with a terminal part 45 with a generally triangular geometry. In the unopened position shown in FIG. 4A the part 45 rests on a bead 22 formed on the interior of the sidewall, towards its free end.

Figure 4B:
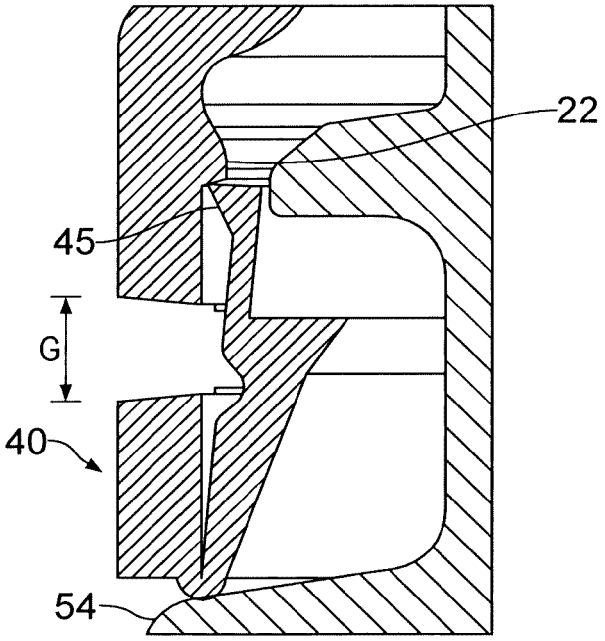
FIG. 4B shows the region of FIG. 4A corresponding to FIG. 2B.

If the band breaks 40 away from the sidewall 21 and then the closure is screwed back down, the sidewall bead 22 now pushes down on the terminal part 45 of the band flap extension 43 and this pushes the band 40 down, as shown in FIG. 4B to form and maintain a gap G.

By using the closure base to push down on the folded flap part of the drop band this ensures that there is a clear gap between the free end of the sidewall and the broken away drop band. In this embodiment the base 20 pushes the band 40 down until it abuts against the neck bead 51.

If the band has already dropped the gap G is maintained; if the band remains on the bead then it is pushed off the bead and down away from the sidewall as the closure is reapplied.

Figure 5:
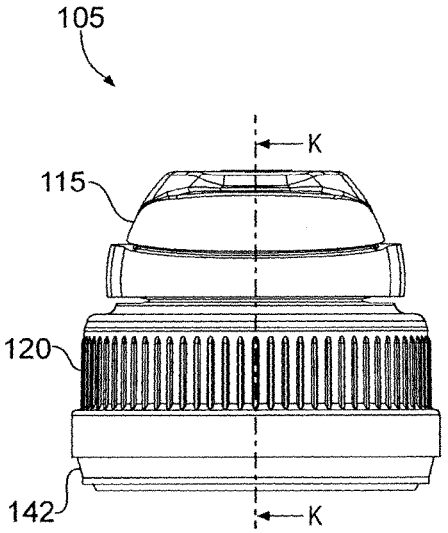
FIG. 5 is a front view of a closure body formed according to the present invention and shown in an as-moulded condition.
Figure 6:
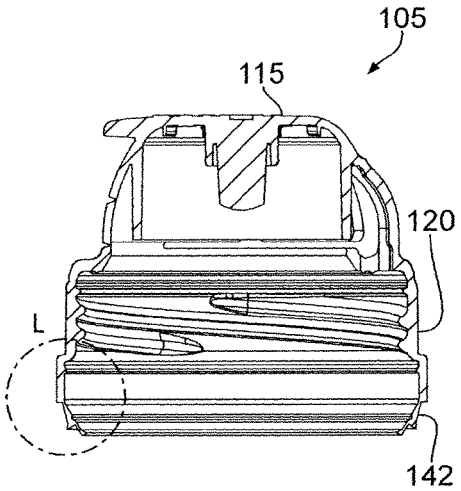
FIG. 6 is a section of the closure of FIG. 5 taken along line K-K.
Figure 7:
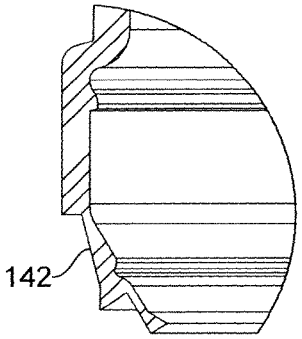
FIG. 7 is a magnified view of the region L of FIG. 6.

FIGS. 5 to 7 show a closure body 105 formed according to an alternative embodiment.

The body is very similar to that shown in FIGS. 1 to 4 and comprises a lid 115 hingedly connected to a base 120.

In this embodiment the flap 142 is moulded in a position in which it extends downwardly with respect to the sidewall 121 and is then folded up so that it extends almost parallel thereto and extends up into the interior of the sidewall. After folding the closure is slit to form a frangible line (formed by bridges) between the sidewall 121 and the drop band 140.

Figure 8:
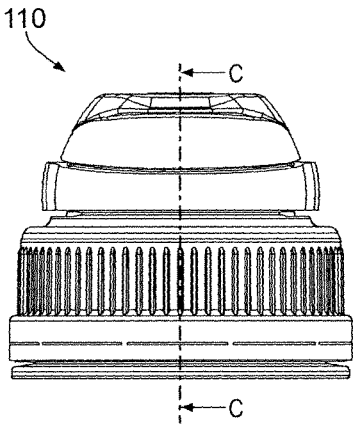
FIG. 8 is a front view showing the closure of FIG. 5 fully assembled and fitted on to a container neck.
Figure 9:
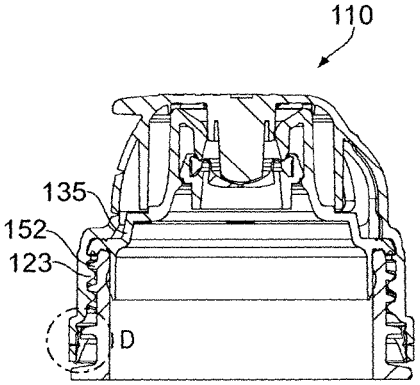
FIG. 9 is a section of the closure/neck of FIG. 8 taken along line C-C.
Figure 10:
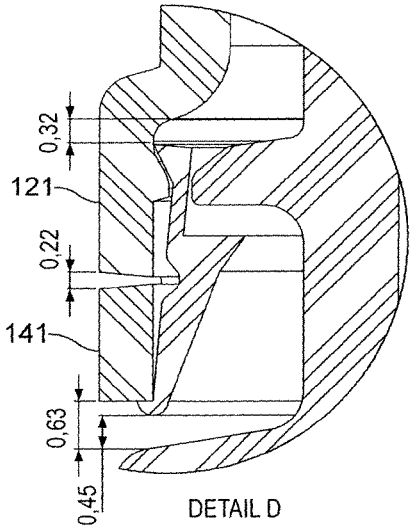
FIG. 10 is a magnified view of the region D of FIG. 9.
Figure 11:
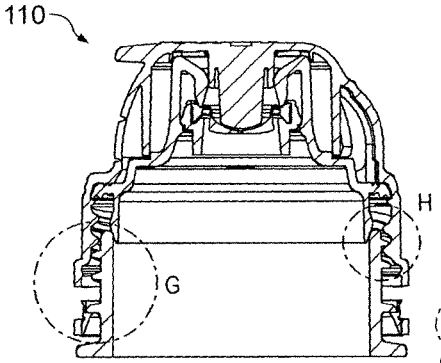
FIG. 11 shows the closure/neck of FIG. 9 when the closure is first unscrewed from the neck.

In FIGS. 8 to 10 the body 105 is shown fitted with a separate spout member 135 to form a closure 110 and connected to a container neck 150 by engagement of internal screw threads 123 on the body base sidewall 121 and external screw threads 152 on the neck.

In Figures II, 13 and 15 the closure 110 is shown partially removed from the neck 150 so that the band 140 is broken away from the sidewall 121. The band 140 may or may not fall down onto the neck transfer ring 154.

Figure 12:
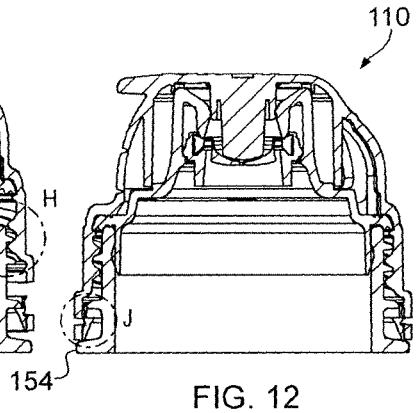
FIG. 12 shows the closure/neck of FIG. 11 when the closure is re-closed onto the neck.
Figure 13:
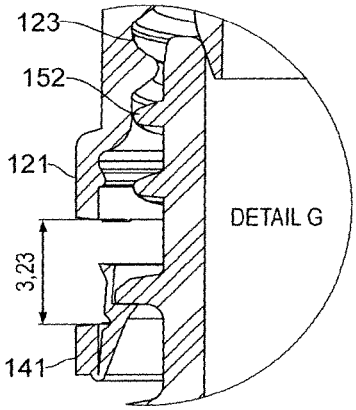
FIG. 13 is a magnified view of the region G of FIG. 11.
Figure 14:
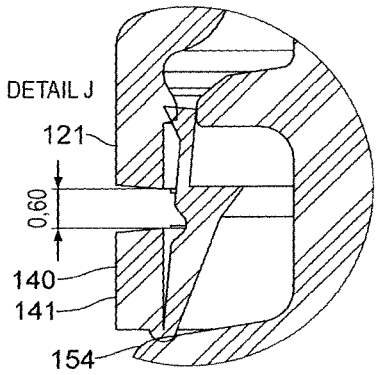
FIG. 14 is a magnified view of the region J of FIG. 12.
Figure 15:
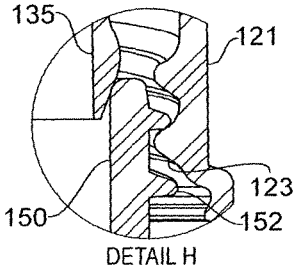
FIG. 15 is a magnified view of the region H of FIG. 11.

In FIGS. 12 and 14 the closure 110 is shown re-applied to the container neck 150. The sidewall bead 122 pushes down on the terminal part 145 of the flap 142 to force the band 140 down onto the ring 154.

Figure 16:
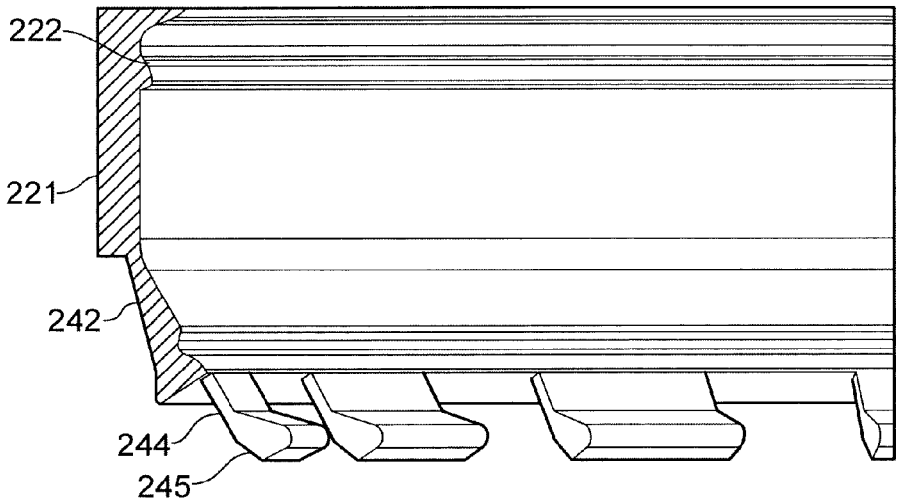
FIG. 16 shows the region of a tamper-evident drop band of a closure formed according to an alternative embodiment.
Figure 17:
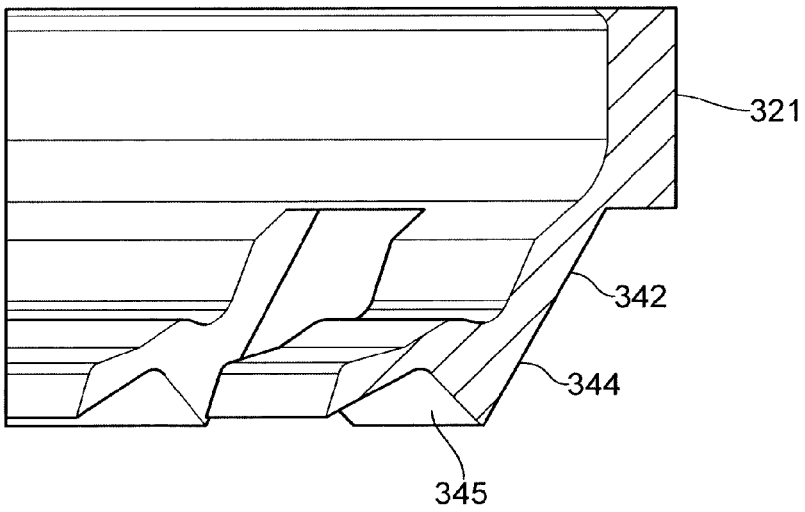
FIG. 17 shows the region of a tamper-evident drop band of a closure formed according to an alternative embodiment.

In FIGS. 1 to 14 the band flap 142 is generally annular and is continuous. In other embodiments, for example as shown in FIGS. 16 and 17 the flap 242, 342 may be discontinuous and instead comprise a plurality of hook-like flaps 260, 360 each comprising an extension part 244, 344 and a terminal part 245, 345.

A closure 410 formed with a discontinuous flap is shown in FIGS. 18 to 21.

The closure 410 is a one-piece body with a generally disc-shape top plate 411 from the periphery of which depends a generally cylindrical sidewall 421.

Figure 18:
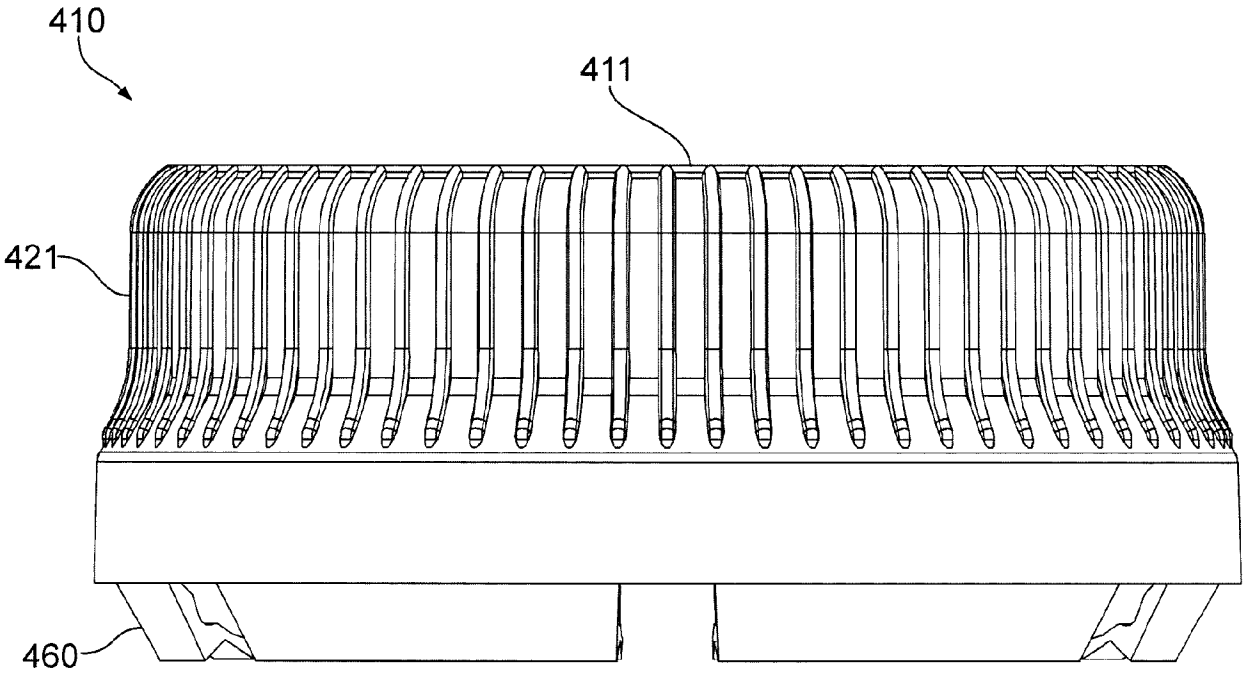
FIG. 18 is a side view of a closure formed according to an alternative embodiment and shown in an as-moulded condition.
Figure 19:
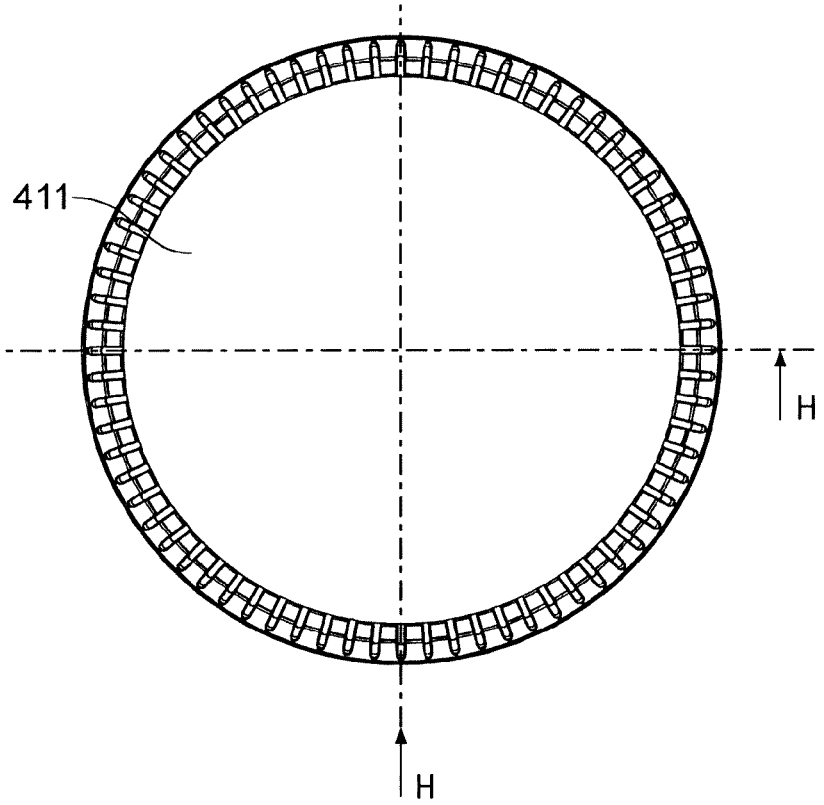
FIG. 19 is a plan view of the closure of FIG. 18.
Figure 20:
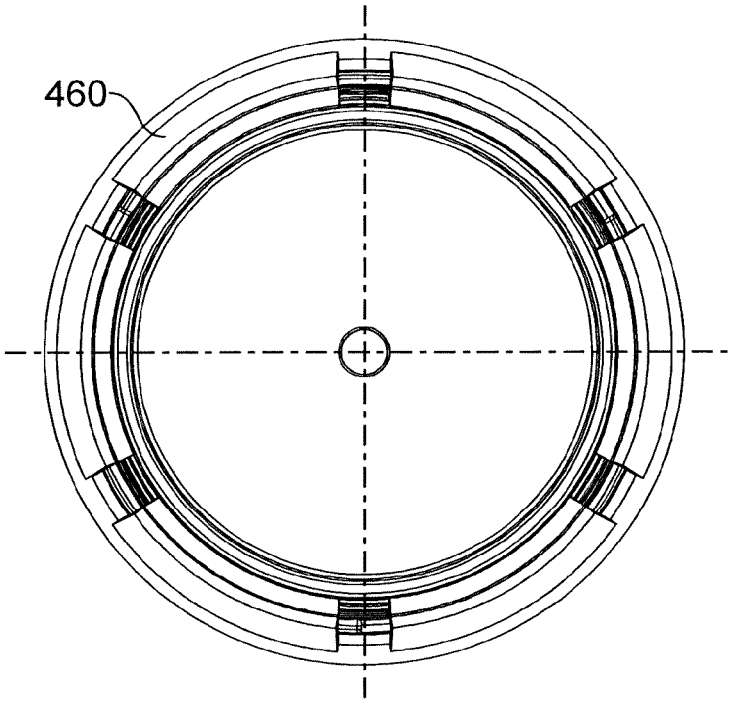
FIG. 20 is an underplan view of the closure of FIG. 18.
Figure 21:
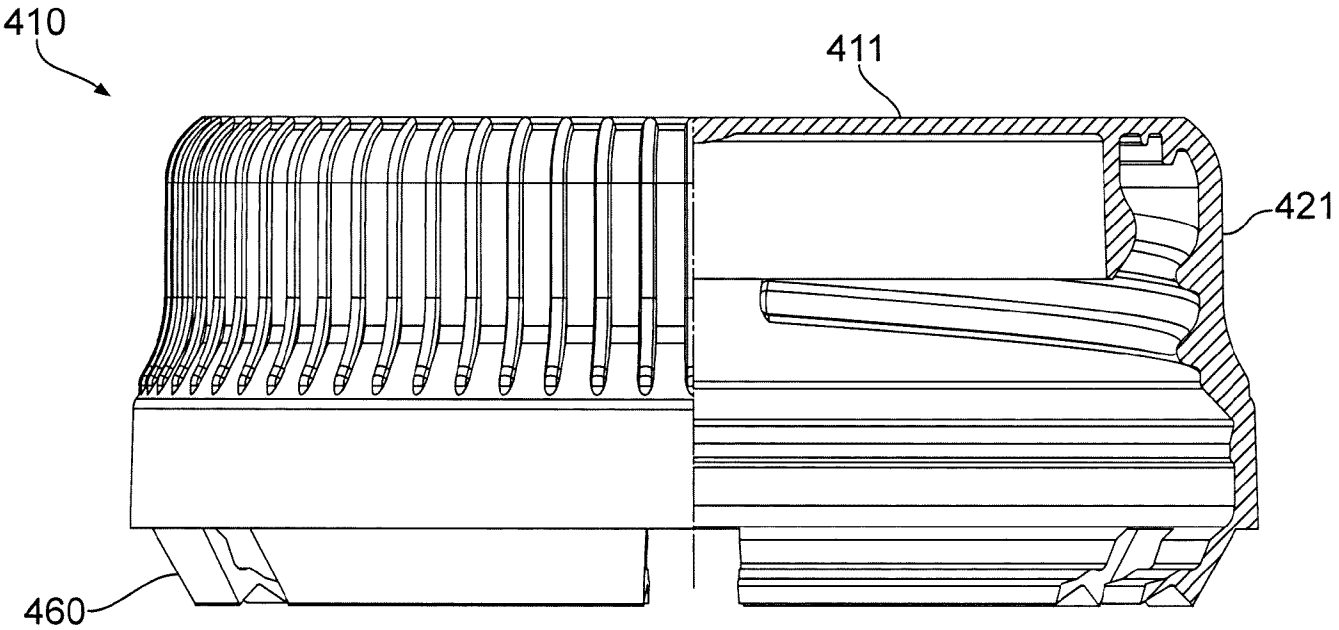
FIG. 21 is a section of the closure of FIG. 19 taken along line H-H.

FIG. 18 shows the closure 410 in an as moulded condition with retention flap 460 shown in a downwardly folded position. The flaps are upturned and a frangible line is formed at the open end of the sidewall to define the tamper-evident drop band.

Operation of the closure 410 is illustrated in FIGS. 22A to 22D.

Figure 22D:
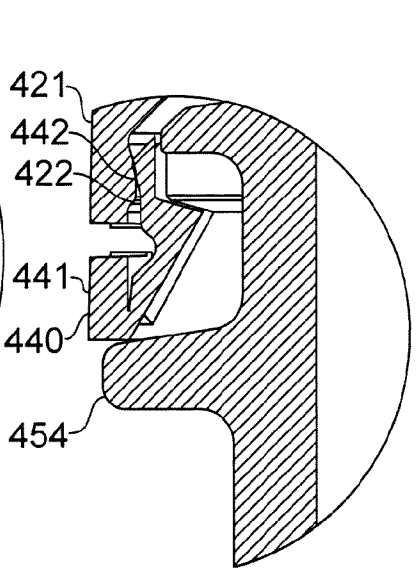
FIGS. 22A to 22D is a sequence of drawings showing the closure of FIGS. 18 to 21 fitted to a closure and during removal and re-closure of the closure base.
Figure 22C:
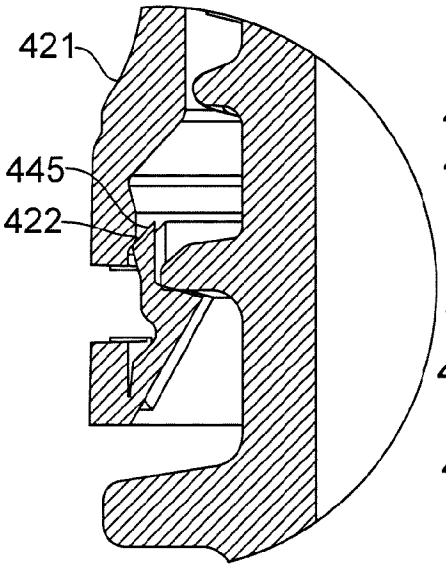
Figure 22B:
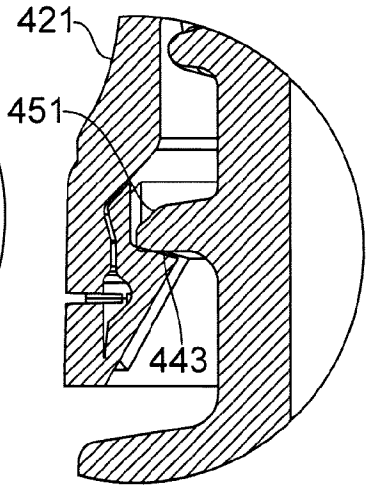
Figure 22A:
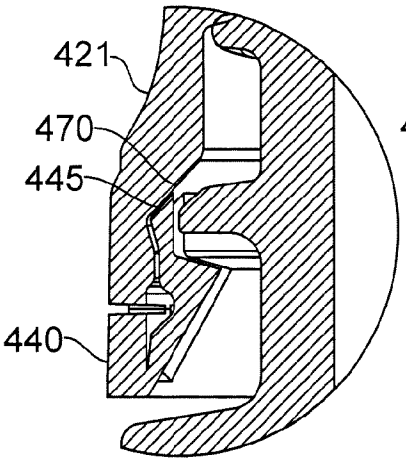

In FIG. 22A the closure 410 is shown fitted to a container neck 450. The terminal part 445 of the flaps 460 rest against a parallel inclined surface 470 formed on the sidewall 421.

In FIG. 228 the closure starts to be unscrewed from the neck. The abutment surface 443 on the flaps abuts against the neck bead 451. Further unscrewing causes the band 441 to break away from the sidewall 421.

In FIG. 22C the closure is being screwed back onto the neck. A bead 422 on the sidewall 421 presses onto the terminal parts 445, causing the band 440 to drop down onto the neck transfer ring 454, after which the extension part 442 of the flaps passes back over the bead 422, as shown in FIG. 22D.

Figure 23:
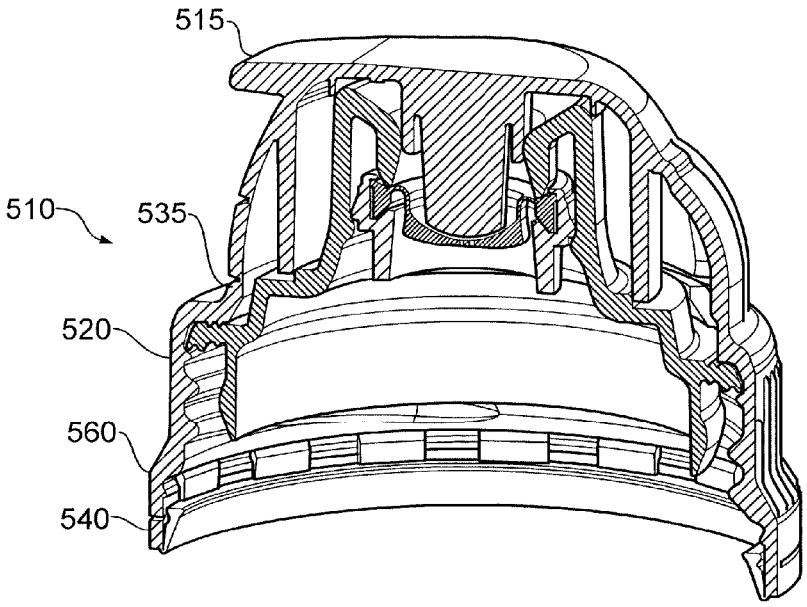
FIG. 23 is a section of a closure formed according to an alternative embodiment based on the drop band of FIG. 16.
Figure 24:
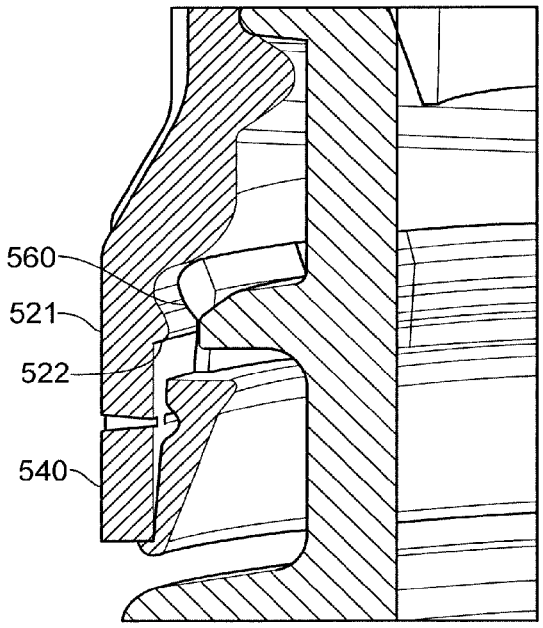
FIG. 24 is a magnified view of the drop band of FIG. 23.

FIG. 23 is a section of a closure 510 formed according to an alternative embodiment having a drop band 540 based on the drop band of FIG. 16 and having a plurality of "fish hook" flaps 560. FIG. 24 is a magnified view of the drop band of FIG. 23.

Figure 25:
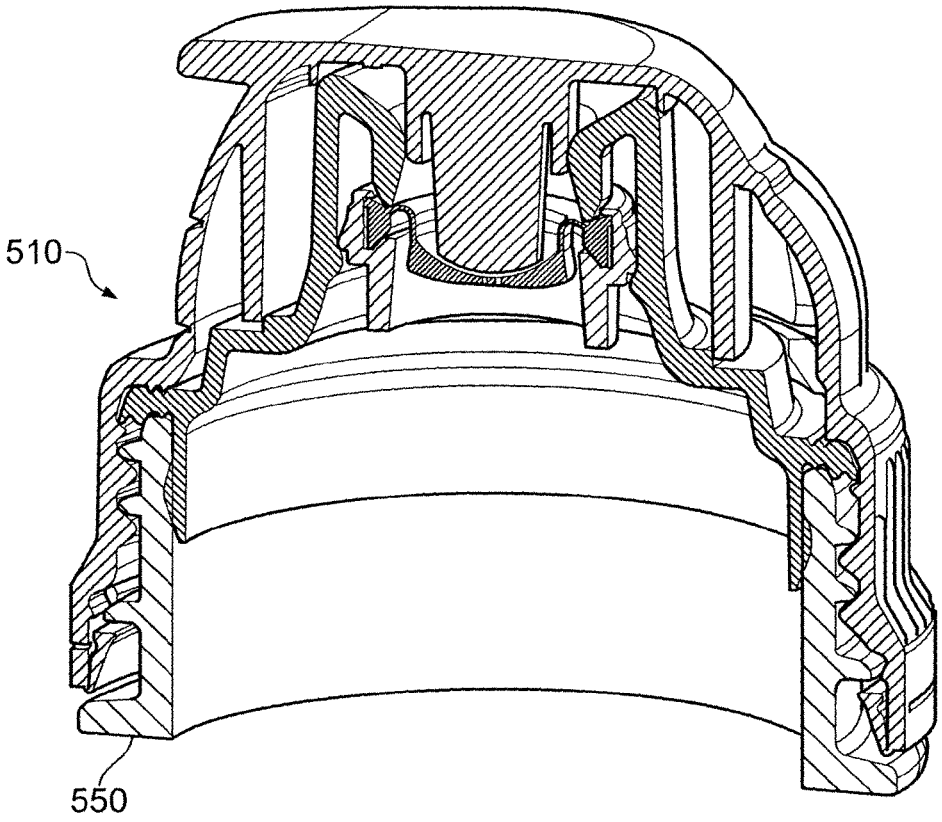
FIG. 25 shows the closure of FIG. 23 fitted onto a container neck.

FIG. 25 shows the closure of FIG. 23 fitted onto a container neck.

Figure 26:
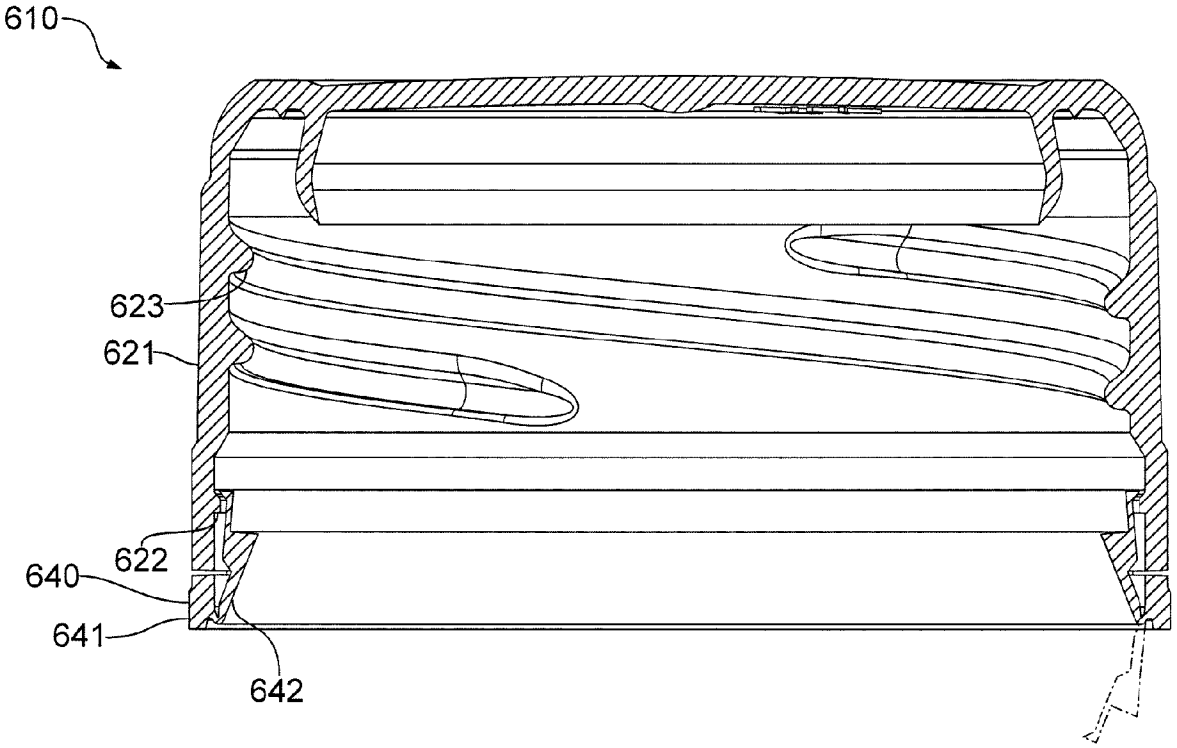
FIG. 26 is a section of a one-piece beverage closure having a drop band similar to the band shown in FIGS. 1 to 15.

FIG. 26 is a section of a one-piece beverage closure having a drop band similar to the band shown in FIGS. 1 to 15.

Where shown, dimensions are not limiting and are merely by way of example,

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A tamper-evident closure for a container, the closure comprising a base and a lid, the base is attachable to a container neck, the base comprising a sidewall having a free end, the closure further comprising a tamper-evident drop band, the tamper-evident drop band including an annular band, the annular band being frangibly connected to said free end of said sidewall, the tamper-evident drop band further comprising a flap that extends radially inwards of the annular band when the closure is fitted onto a container neck, the flap including an abutment for engaging the container neck to cause the tamper-evident drop band to break away from the sidewall if an attempt is made to remove the closure from the neck once fitted, the flap further comprising an extension against which the base sidewall abuts if the closure is reapplied and pushes or holds the annular band away from the free end of the base sidewall to form and maintain a gap therebetween.

2. A closure as claimed in claim 1, in which the sidewall comprises an internal bead for pushing the extension in the reapplied position.

3. A closure as claimed in claim 2, in which part of the extension is initially located above the bead and is pulled down over the bead upon removal of the closure, and thereafter cannot pass back over the bead.

4. A closure as claimed in claim 2, in which the internal bead is continuous or discontinuous.

5. A closure as claimed in claim 1, in which the extension comprises a plurality of flaps.

6. A closure as claimed in claim 1, in which the band is pushed so that the band is pressed against a container neck transfer bead.

7. A closure as claimed in claim 1, in which the band is formed with the flap in an unfolded position.

8. A closure as claimed in claim 1, in which the lid is hingedly connected to the base.

9. A closure as claimed in claim 8, in which there is provided a tamper-evident means for indicating if the lid has been opened.

10. A closure as claimed in claim 1, in which the base comprises a dispensing member.

11. A closure as claimed in claim 10, in which the member is a spout.

12. A closure as claimed in claim 10, in which the member comprises a self-closing valve.

13. A closure as claimed in claim 1, in which the base is screw threadable onto a neck.

14. A closure as claimed in claim 1, in which the band comprises anti-rotation means for improving breakage.

15. A container fitted with a closure as claimed in claim 1.

16. A flip-top sportscap for a container neck, the sportscap comprising a screw-threaded base and a lid joined by a hinge, the base comprising a sidewall at the free end of which a tamper-evident drop-band is frangibly connected, the drop band comprising a folded flap having a part which engages a container neck in use and causes the band to break away from the sidewall if the base is unscrewed, the flap further comprising an extended free end and the sidewall comprising an abutment bead, the bead abutting against the free end of the band to push the band away from the free end of the sidewall if the base is re-screwed onto the neck.

17. A tamper-evident closure for a container, the tamper-evident closure comprising:

a body, the body is attachable to a container neck, the body comprising a sidewall having a free end; and a tamper-evident drop band, the tamper-evident drop band including an annular band, the annular band being frangibly connected to said free end of said sidewall, the tamper-evident drop band further comprising a flap which extends radially inwards of the annular band when the closure is fitted onto a container neck, the flap including an abutment for engaging the container neck to cause the tamper-evident drop band to break away from the sidewall if an attempt is made to remove the closure from the neck once fitted, the flap further comprising an extension against which the base sidewall pushes if the closure is reapplied and pushes or holds the annular band away from the free end of the base sidewall.

* * * * *